US008026685B2

(12) United States Patent
Wenzel et al.

(10) Patent No.: US 8,026,685 B2
(45) Date of Patent: Sep. 27, 2011

(54) DEVICE FOR CONTROLLING THE MOVEMENT OF A PLURALITY OF MOVEABLE FURNITURE PARTS, AND A METHOD FOR CONFIGURATION OF A DEVICE SUCH AS THIS, AND PIECE OF FURNITURE

(75) Inventors: Holger Wenzel, Lindau (DE); Helmut Wetschko, Klaus-Weiler (AT)

(73) Assignees: Grass GmbH, Hochst (AT); Küster Automotive Door Systems GmbH, Ehringshausen (DE)

( * ) Notice: Subject to any disclaimer, the term of this patent is extended or adjusted under 35 U.S.C. 154(b) by 363 days.

(21) Appl. No.: 12/243,168

(22) Filed: Oct. 1, 2008

(65) Prior Publication Data

US 2009/0134752 A1 May 28, 2009

Related U.S. Application Data

(63) Continuation of application No. PCT/EP2007/003028, filed on Apr. 4, 2007.

(30) Foreign Application Priority Data

Apr. 4, 2006 (DE) ..... 10 2006 016 102
Apr. 4, 2006 (DE) ..... 20 2006 005 580 U
Apr. 4, 2006 (DE) ..... 20 2006 005 581 U

(51) Int. Cl.
*G05B 5/00* (2006.01)

(52) U.S. Cl. ..... 318/466; 318/446; 318/646

(58) Field of Classification Search ..... 318/466, 318/446, 646, 9, 568.13; 312/319.5
See application file for complete search history.

(56) References Cited

U.S. PATENT DOCUMENTS

| | | | | |
|---|---|---|---|---|
| 3,622,216 | A * | 11/1971 | Haunost | 312/219 |
| 3,990,630 | A * | 11/1976 | Cutter | 232/44 |
| 6,685,288 | B1 | 2/2004 | MacMillan | |
| 2003/0122519 | A1* | 7/2003 | Huber et al. | 318/646 |
| 2006/0186776 | A1* | 8/2006 | Tsai | 312/408 |

FOREIGN PATENT DOCUMENTS

| | | | |
|---|---|---|---|
| DE | 88 02 655 | | 8/1988 |
| DE | 101 05 756 | A1 | 8/2001 |
| DE | 1 323 363 | A1 | 7/2003 |
| DE | 1 323 364 | A1 | 7/2003 |
| DE | 1 374 732 | A1 | 1/2004 |
| DE | 203 08 256 | U1 | 6/2004 |
| DE | 20 2004 007 170 | U1 | 9/2004 |
| DE | 007 723 UI | | 6/2005 |
| DE | 2005/058092 | A1 | 6/2005 |

(Continued)

*Primary Examiner* — Karen Masih
(74) *Attorney, Agent, or Firm* — Burr & Brown

(57) ABSTRACT

The invention relates to a device for controlling the movement of a plurality of moveable furniture parts which can be moved in a driven manner relative to a stationary furniture part by means of a drive unit via a monitoring unit for monitoring the movement of the moveable furniture parts. According to the invention, the monitoring unit is designed such that, as long as one moveable furniture part is being moved in a driven manner on a predetermined movement section, none of the other furniture parts which can be moved in a driven manner are moveable in a driven manner. The invention also relates to a piece of furniture and to a method for configuration of a device for controlling the movement of moveable furniture parts.

18 Claims, 1 Drawing Sheet

FOREIGN PATENT DOCUMENTS

| | | | |
|---|---|---|---|
| DE | 20 2005 013 128 | U1 | 12/2005 |
| DE | 10 2004 045 568 | A1 | 3/2006 |
| DE | 20 2005 018 353 | U1 | 3/2006 |
| DE | 10 2004 045 567 | A1 | 4/2006 |
| DE | 20 2005 006 945 | U1 | 6/2006 |
| DE | 20 2006 002 103 | U1 | 8/2006 |
| DE | 20 2006 012 976 | U1 | 12/2006 |
| DE | 20 2006 012 656 | U1 | 2/2007 |
| DE | 20 2005 021 123 | U1 | 3/2007 |
| WO | 2004/100717 | A1 | 11/2004 |
| WO | 2004/100718 | A1 | 11/2004 |

* cited by examiner

DEVICE FOR CONTROLLING THE MOVEMENT OF A PLURALITY OF MOVEABLE FURNITURE PARTS, AND A METHOD FOR CONFIGURATION OF A DEVICE SUCH AS THIS, AND PIECE OF FURNITURE

CROSS REFERENCE TO RELATED APPLICATIONS

This application is a continuation of International Application No. PCT/EP2007/003028, filed Apr. 4, 2007, which designated the United States, and claims the benefit under 35 USC §119(a)-(d) of German Application Nos. 20 2006 005 580.0, 20 2006 005 581.9 and 10 2006 016 102.5, all of which were filed Apr. 4, 2006, the entireties of which are incorporated herein by reference.

FIELD OF THE INVENTION

The invention relates to a device for controlling the movement of furniture parts, to a piece of furniture including the device, and to a method of operating the device.

BACKGROUND OF THE INVENTION

Devices for controlling the movement of furniture parts which can be moved relative to a stationary furniture part are known from the prior art, in which case the moveable furniture part can be moved in a driven manner with the aid of a drive unit and a monitoring unit for monitoring the movement of the moveable furniture parts.

By way of example, furniture parts which are guided such that they can be moved or can be pivoted on fittings, for example drawers, hatches, doors and the like, are moved with respect to a furniture housing with purely mechanical and/or electrical assistance, for example driven via an electric motor. Particularly in the case of modern pieces of furniture, which may provide additional functions or a relatively high level of control convenience, particular account must be taken of the installation and setting-up effort. This depends essentially on the number of furniture parts which can be moved in a driven manner and on the complexity of movement options to be set up for moveable furniture parts.

SUMMARY OF THE INVENTION

The object of the present invention is to keep the installation and setting-up effort for a device for controlling the movement of furniture parts which can be moved in a driven manner and for corresponding pieces of furniture comparatively low, with the capability to achieve a high level of control convenience.

The invention is based first of all on a device for controlling the movement of a plurality of moveable furniture parts which can be moved in a driven manner relative to a stationary furniture part by means of a drive unit via a monitoring unit for monitoring the movement of the moveable furniture parts. One major aspect of the invention is that the monitoring unit is designed such that, as long as one moveable furniture part is being moved in a driven manner on a predetermined movement section, none of the other furniture parts which can be moved in a driven manner are moveable in a driven manner. The installation and setting-up effort for the device for controlling movement and for a correspondingly equipped piece of furniture is therefore advantageously comparatively low. Furthermore, this allows simple and safe operation of furniture parts which can be moved in a driven manner, as is advantageous, for example, in the kitchen area with a plurality of furniture drawer units which can be moved in a driven manner, in particular electrically.

By way of example, moveable furniture parts may be drawers, doors, hatches, tablar panels, wire baskets, pharmacy cabinets, rotating racks, carousels or the like, which in particular can be moved or shifted, rotated and/or pivoted on the piece of furniture.

The driven movement of only one moveable furniture part means that undesirable states resulting from moveable furniture parts being moved in a driven manner at the same time can be precluded, in particular damage caused by collisions between furniture parts moving at the same time or injury hazards resulting from body parts or fingers becoming trapped or crushed between respective sections of the furniture parts which are moving in a driven manner. In addition, a considerable simplification can be achieved from the safety point of view, in particular because, for example, the relative velocity of adjacent furniture parts which are being moved in a driven manner at the same time within the predetermined movement section is not doubled.

The solution provided by the present invention can be defined for a group, which can be selected individually, of moveable furniture parts or for the totality of furniture parts which can be moved in a driven manner in a system, for example in a room. In the simplest case, as long as a furniture part which can be moved in a driven manner in a room is being moved for example in a driven manner on a predetermined movement section, a driven movement by means of the drive unit is precluded for all or for all the other, moveable furniture parts in the room, if the group comprises all of the furniture parts which can be moved in a driven manner in the room. Alternatively, the group, for example, may also be limited to moveable furniture parts in a part of the room, and/or for example to specific furniture parts which can be moved and are arranged in a separate area with respect to one another. For example, it is possible to create a situation in which, as long as one furniture part of the relevant furniture parts which can be moved in a driven manner is being moved in a driven manner on a predetermined movement section, all the other at least adjacent furniture parts which can be moved in a driven manner cannot be moved in a driven manner. Adjacent moveable furniture parts to a moveable furniture part under consideration may be furniture parts which are arranged, for example, above, below, to the left, to the right, at an angle or diagonally to, at right angles to and/or opposite this furniture part.

The selectable group can be defined as required and may relate to furniture parts in the same stationary furniture part or furniture housing or in different stationary furniture parts. The group of the predetermined furniture parts may, in particular, be a furniture part under consideration or may comprise all the furniture parts which are located within a definable area with respect to it or are adjacent to it. Drivable furniture parts which are spatially oriented differently may also be present within a group, for example opposite moveable furniture parts or moveable furniture parts arranged at right angles.

The procedure of the present invention is therefore also particularly advantageous since there is no need for any comparatively complex matching or association between the moveable furniture parts, in order otherwise to configure for in particular each individual moveable furniture part which at least one furniture part may or may not be moved in a driven manner at the same time. According to the invention, an amount of configuration and programming work which may otherwise not be inconsiderable, in particular by specialist personnel, can therefore be avoided for a movement controlling device and for a piece of furniture equipped with it, thus making it possible advantageously to minimize to a major extent, or even to reduce to zero, the costs, the fault susceptibility and the time required, by means of the solution according to the present invention.

The final setting for end usage can advantageously be produced before or at the latest during the construction of the piece of furniture or the device for controlling movement. It is particularly advantageous for the configuration process to be completed or defined actually when the system is in the delivery state, and for the system to be ready for use on completion of the assembly of the system. Overall, an end-user setting can be set up even in the works or at the installation location, thus minimizing the configuration effort. In particular, there is no need to carry out any comparatively complex configuration process, for example during production or later, for example in situ, with a laptop, thus making it possible to improve the acceptance for the system by the user.

Furthermore, the procedure of the present invention makes it possible to comply with stringent safety standards based on the applicable regulations and guidelines or based on the requirements of the examination authorities, for example LGA requirements, without any problems.

The predetermined movement section for a moveable furniture part can be selected and, for example, may comprise the entire or maximum possible movement distance for a moveable furniture part which can be moved through in a driven manner by the furniture part, or may be only a part or a plurality of subsections of this total distance which can be moved over in a driven manner by the furniture part. By way of example, this may be regarded as the entire distance which can be moved over minus the first approximately 10 to 70 millimeters from the closed position. In the case of a furniture part which can be rotated or pivoted, this subsection may be regarded, for example, as approximately 5 to 25 angular degrees from the closed position, or the predetermined movement section may relate to the entire angle range covered during the driven movement.

The monitoring unit may, in particular, be understood to be a central controller or computation unit for the moveable furniture parts.

It is also possible that the monitoring unit is designed to allow the driven movement of another driven furniture part when the furniture part which is being moved in a driven manner is being moved in a driven manner outside the predetermined movement section. In consequence, further movement sections, which do not lie on the predetermined movement section, exist, on which the furniture part under consideration is moved in a driven manner, and during which a further furniture part which can be moved in a driven manner is likewise moved by the drive unit. Such simultaneity of driven movements by at least two moveable furniture parts can considerably improve the control convenience for a piece of furniture having a plurality of moveable furniture parts.

A movement section of a furniture part which can be moved in a driven manner, for example a drawer, may in particular be provided by known pulling-out guides with guide rails, for example in the form of a partial or full drawer extensions. The movement section may, for example, in particular comprise the movement distance provided by means of the pulling-out guide, which can be moved over in a driven manner by the moveable furniture part. The movement section may relate to an opening and/or closing movement of a moveable furniture part.

Furthermore, it is advantageous for the monitoring unit to be designed such that the predetermined movement section can be defined to be a section in which two furniture parts, which are moving in a driven manner in opposite directions, represent a risk of trapping. If two furniture parts which are moving in a driven manner move in opposite directions, a risk of trapping can occur for body parts or objects which enter between them at least at times or in places, for example as a result of the edge sections of the two furniture parts moving past one another.

In principle, it is also possible to avoid undesirable movement states or the risk of trapping when furniture parts are being moved in a driven manner at the same time and which are being moved in the same direction at a different velocity, for example being opened or closed at the same time.

In order to avoid undesirable movement states and potential hazards, the predetermined movement section is matched to corresponding possible hazards, and simultaneous movement of two moveable furniture parts in these sections is avoided. This makes it possible to preclude trapping of fingers or body parts between front parts of furniture parts, for example furniture drawers, which in particular are moving past one another in opposite directions.

In particular, a predetermined movement section can be determined in such a way that a simultaneous driven movement of two furniture parts is possible only when the possibility of a trapping gap between parts of the furniture parts which are moving past one another is precluded. The definition of the size of the trapping gap can be based on body parts which are comparatively small or have small dimensions, for example fingers, hands or an arm, in particular a child's arm, no longer being able to fit between boundaries at the narrowest point of the trapping gap.

This can be implemented in such a way that, in the case of two furniture parts which are being moved in a driven manner in opposite directions, one furniture part which has been closed in a driven manner, for example a drawer, is decelerated and stopped on reaching a zone where there is a risk of crushing. The second moveable furniture part opens further or in particular is moved without any reduction in speed to the final position or open position. The furniture part which has been stopped can be moved to the closed position after this, or as soon as the furniture part which is being opened has left the trapping hazard zone. The furniture part which is being opened is advantageously opened before the furniture part which is being closed has been closed completely, thus allowing access to the open furniture part as early as possible.

It is also possible that the monitoring unit is designed to define the predetermined movement section to be a section of the movement of the furniture part which can be moved in a driven manner, from an open position until a defined remaining movement distance is reached before a closed position. In order in particular to avoid a possible trapping and/or crushing hazard for a person, the movement section can be defined such that, while closing a moveable furniture part which entirely or partially opens, another driven moveable furniture part cannot be moved until shortly before the first furniture part has reached a closed position. A relatively high relative velocity between the closing furniture part and a furniture part which is being moved at the same time and in particular is located adjacent to the closing furniture part can thus be avoided over this section. Thus, in the case of furniture parts which are moving at the same time but in opposite directions, as is very frequently required or desired in practice, a relative velocity which results from the addition of the two individual velocities is precluded in a substantial part, or over the majority, of the entire possible movement section which can be moved over in a driven manner. In particular and advantageously, simultaneous movement of the second moveable furniture part is possible only when the first furniture part which can be moved in a driven manner is shortly before its closed position, thus virtually precluding trapping and/or an injury hazard. For example, because the movement has already been decelerated shortly before reaching the closed position, an injury risk relating to this is considered to be non-critical. An injury risk is significant in particular only above a critical relative velocity of two furniture parts which are moving simultaneously. This critical relative velocity, which is obtained, for example, from empirical values can be included in the design of the predetermined movement section.

The monitoring unit is preferably designed such that driven movement of one and only one of the other furniture parts is possible during the driven movement of the closing furniture part, after passing a point approximately 10 to 70 millimeters before reaching the closed position. The driven movement of another furniture part, in particular of a directly adjacent furniture part, may thus be possible over a comparatively short moving distance before reaching a stationary or closed position, in comparison to the overall possible movement distance which may amount to several hundred millimeters. The predetermined movement section in which no driven movement of a second moveable furniture part is permissible may then, for example, cover the entire movement distance before the start of the remaining movement distance, which, in particular corresponds to the entire possible movement distance minus 10 to 70 mm. Movement of an adjacent driven furniture part is therefore possible for a comparatively short remaining movement distance before reaching a closed position. However, this does not present any problems since this furniture part is actually still being accelerated from rest in this phase that is being considered, and therefore initially has relatively little kinetic energy. A corresponding effect can be observed with the closing furniture part, since the closing furniture part is generally being driven in a decelerated manner within this remaining movement distance, or at least is starting to slow down within the remaining movement distance, with its kinetic energy likewise being reduced, which is likewise advantageous with regard to a possible potential hazard from trapping or crushing, for example on body parts.

It is particularly advantageous that the monitoring unit is designed to ignore an input command from the outside to initiate the movement of one of the other furniture parts for as long as the furniture part which can be moved in a driven manner is being moved in a driven manner on the predetermined movement section. This makes it possible, safely and with little effort, to avoid an initiation command from the outside to move a further furniture part in a driven manner not being processed while one furniture part is already being moved in a driven manner. If required, this therefore makes it possible to reduce the complexity of the regulation or control provided by the monitoring unit. By way of example, the input command from the outside may be produced by someone operating a control element or pushing on a front part of a moveable furniture part. In principle, the monitoring unit can also be designed such that the conditions to ignore a corresponding input command from the outside are defined differently, for example such commands can be ignored when any furniture part is being moved in a driven manner.

The monitoring unit is preferably designed to take account of an input command for initiation of the movement of one of the other furniture parts with a time offset, during the driven movement of the moveable furniture part within a comparatively short predetermined time interval before leaving the predetermined movement section. By way of example, this makes it possible to increase the control convenience for a correspondingly equipped piece of furniture. This is because it can be designed such that, while one furniture part is being moved in a driven manner, an input command to open a closed moveable furniture part which occurred only a few tenths of seconds too early and would thus be ignored, is nevertheless considered. This means that there is no need for a person to issue a corresponding command once again, because a furniture part was still on the predetermined movement section at the time of the input command.

It is also possible that the monitoring unit is designed such that the time offset is variable. The time offset can thus be set to an individually desired time interval, for example to a few tenths of seconds up to a maximum of about five seconds. In particular, the time offset can be adapted and may correspond to the time which the moveable furniture part which is being driven at that time requires in order to reach a position which is considered not to be hazardous or for which, when this position is reached, a second moveable furniture part can likewise be moved in a driven manner. Further subsequent input commands or opening commands to other moveable furniture parts are ignored.

In another embodiment of the invention, the monitoring unit is designed such that the, in the predetermined time interval, one and only one input command, which occurs first in time, for initiation of the movement of one of the other furniture parts is carried out with a time offset, in such a way that subsequent input commands for initiation of the movement of further furniture parts are ignored. One and only one input command, which was the one that occurred first in time, can therefore be processed in the predetermined time interval under consideration, and the at least one subsequent input command is ignored. A second input command is ignored in the predefined time interval. This allows the monitoring unit to be designed to be correspondingly less complex, and input commands relating to movement processes that are not permissible need not be processed in the monitoring unit, making it possible to reduce the workload of the monitoring unit.

It is also preferable for the monitoring unit to be designed to decelerate the velocity of the selected furniture part which can be moved in a driven manner, over a predefinable distance before reaching a stationary position, such that a driven movement of another furniture part is permitted on the basis of the reduced velocity of the decelerated furniture part, while it is still moving. This is because, the deceleration means that the relative velocity between the furniture part under consideration and a second furniture part which is being moved in a driven manner cannot be above a critical value and no potential hazard can therefore arise from them moving past one another. This makes it possible to achieve a time savings in comparison to those situations in which a further moveable furniture part may be moved in a driven manner only when a moveable furniture part reaches a stationary position to which it has been moved in a driven manner. In particular, a stationary position of a moveable furniture part may be a completely closed or completely open position with respect to the stationary furniture part, although it may also relate to any desired stationary positions between these two limit movement positions, to be precise completely closed or completely open positions.

The monitoring unit is advantageously designed to monitor the movement of a definable group of moveable furniture parts from a plurality of furniture parts which can be moved in a driven manner and are accommodated in an area, such that, as long as one furniture part in the group is being moved in a driven manner on a predetermined movement section, none of the other furniture parts which can be moved in a driven manner from that group can be moved in a driven manner. The simultaneity of the driven movement of two furniture parts can thus be precluded for a defined group while, in contrast, another group with a plurality of furniture parts which can be moved in a driven manner may be subject to a different setting for its movement monitoring.

For example, when there are a plurality of furniture parts which can be moved in a driven manner in a room, for example a kitchen with a plurality of moveable drawer units, a group of the moveable furniture parts can be predetermined, of which in each case one and only one furniture part can be moved in a driven manner while, in contrast, the other moveable furniture parts which do not belong to the group can be configured differently, for example a plurality of these furniture parts which can be moved in a driven manner can also be moved in a driven manner simultaneously and without any restriction. This may make sense, for example, when the moveable furniture parts which do not belong to the group are arranged so far apart from one another that their simultaneous driven movement does not result in any undesirable states or potential hazards.

The invention also relates to a piece of furniture having at least one stationary furniture part and furniture parts which can be moved in a driven manner, in particular drawers, with a device as described above. This makes it possible to achieve the advantages that have already been discussed, for a corresponding piece of furniture.

In addition, the invention relates to a method for configuration of a device for controlling the movement of a plurality of moveable furniture parts which can be moved in a driven manner relative to a stationary furniture part by means of a drive unit via a monitoring unit for monitoring the movement of the moveable furniture parts, in particular for configuration of a device as described above, in which the method is distinguished in that, the monitoring unit is configured for a defined end-usage state before or during the installation at the installation location of the device. This makes it possible to minimize the configuration effort for the device and for a piece of furniture equipped with it.

BRIEF DESCRIPTION OF THE DRAWING

The single FIGURE illustrates a highly schematically illustrated exemplary embodiment of the invention, and will be described in more detail indicating further advantages and details.

DETAILED DESCRIPTION OF THE INVENTION

Figure 1:
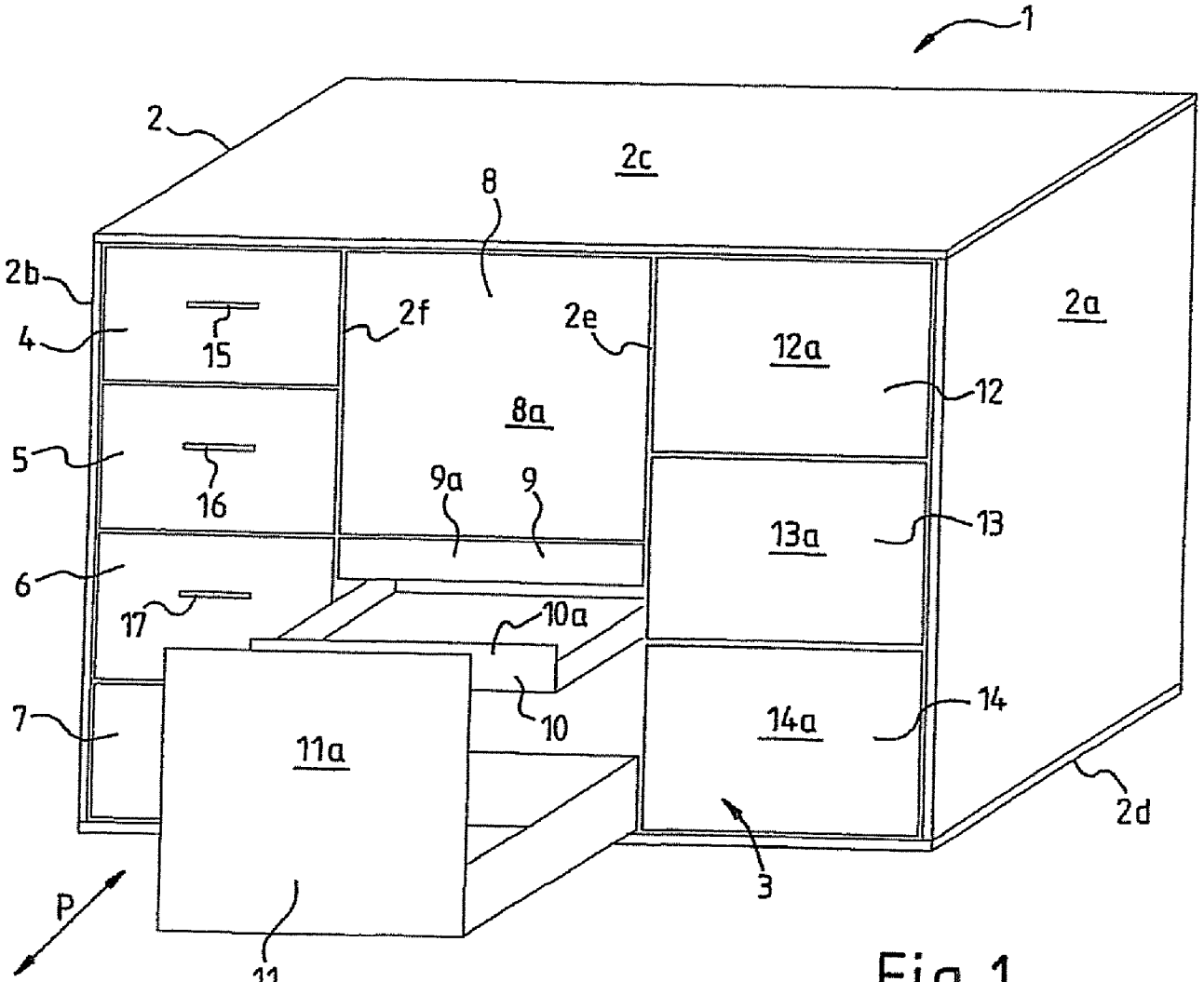
FIG. 1 is a schematic of a front perspective view obliquely from above of a piece of furniture.

FIG. 1 shows a piece of furniture 1 with a stationary furniture part or a furniture housing 2 and furniture drawer units 3, which are guided moveably on it and have a plurality of drawers 4-14. When the furniture drawer units 3 are in the closed state, the piece of furniture 1 has a cuboid shape. The furniture housing 2 comprises two outer side walls 2*a* and 2*b*, an upper part 2*c*, a bottom part 2*d* and also a rear wall, which cannot be seen in FIG. 1. The furniture housing 2 also has inner walls 2*e* and 2*f* which run parallel to the side walls 2*a*, 2*b* in the interior of the furniture housing.

The furniture drawer units 3 are held moveably on the side walls 2*a*, 2*b* and the inner walls 2*e*, 2*f* in the furniture housing 2 via pull-out guides which are not illustrated, for example via known full drawer extensions. The furniture drawer units 3 may be pushed in and pulled out relative to the furniture housing 2 as indicated by the double-headed arrow P. The drawers 4-9 and 12-14 are each located in a closed position, while in contrast the inner drawer 10 is approximately half open, and the outer drawer is entirely open, with respect to the furniture housing 2.

The front face of the piece of furniture 1 with front parts of the furniture drawer units 3 represents a control face for someone to operate the drawers 4-14. Looking at the piece of furniture 1 from the front, the drawers are arranged in three columns, each with a plurality of drawers positioned one above the other. The left-hand gap, seen from the front comprises the identical drawers 4-7 between the side wall 2*b* and the inner wall 2*f*, the center column comprises the drawers 8-11 between the inner walls 2*e* and 2*f*, and the right-hand column comprises the drawers 12-14 between the inner wall 2*e* and the side wall 2*a*.

A device which is not illustrated in FIG. 1, for example a device corresponding to that described in WO 2006/029894 A1, is provided in order to control the movement of the furniture drawer units 3, for driven movement of the furniture drawer units 3 relative to the furniture housing 2, with the driven movement being carried out by means of a drive unit and/or a monitoring unit for monitoring the movement of the furniture drawer units 3.

The drawers 4-6 are each provided on their drawer fronts with a handle element 15-17, and the drawer 7 is provided with a further handle element (not shown) in order to grip the relevant drawer manually and in particular to pull on the drawer. In principle, it is therefore possible for the drawers 4-7 not to be moveably driven by the drive unit but to be moveable only by manual operation. It is also feasible for the drawers 4-7 to be moveable in a driven manner and manually in order, for example, when they are being moved manually by someone, for this movement to be assisted by the drive unit, in particular during opening.

In particular, the other drawers can be moved by means of the drive unit, in which case it is feasible that a drawer which can be moved in a driven manner can also be moved manually. The drive unit may be in many forms and may operate by electrical means, for example with the aid of an electric motor, or non-electrically by mechanical means, or may operate with a combination of these means. The opening and/or closing movement may be entirely or partially driven, for example when ejection means are provided for ejection of the moveable furniture part from its closed position to an at least partially open position.

In the case of the piece of furniture 1, the control plane is formed when the closed drawer fronts lie at least approximately on a plane, although the invention also covers pieces of furniture whose control faces are formed by two or more planes oriented differently in space, and/or the front faces of the closed moveable furniture parts, for example arrangements at right angles or opposite one another, which, for example, are separated and parallel. Arrangements with folding hatches or doors are also covered by the invention, which are positioned one above the other, for example in an upper cabinet and a lower cabinet, in which case at least one folding hatch or door can be moved upward, and another can be moved downward. Any risk of trapping which may occur during such movements can be avoided according to the invention.

The front part 11*a* of the outer drawer 11 covers the front part 9*a* of the inner drawers 9 and the front part 10*a* of the inner drawer 10.

On their front parts 8*a*-14*a*, all of the drawers 8-14 are equipped without a contour or a handle element, or any other aid for pulling on the relevant furniture part. In particular, the drawers 4-14 may be provided, for example, with an ejector or touch-latch functionality, in which case in addition the drawers 4-7 can also manage without such a functionality. Particularly when the drawers 8-14 are provided with a touch-latch functionality, they can accordingly be initiated and opened by tapping on the drawer when in the closed state.

In order to avoid undesirable states in the case of the furniture part 1 and in order to preclude any possible trapping or crushing hazards or collision hazard for a person by drawers which are being moved in a driven manner, the monitoring unit, which is not illustrated, is designed such that, as long as one drawer of all the drawers 4-14 is moving in a driven manner, none of the other drawers which can be moved in a driven manner are moveable in a driven manner.

Furthermore, the monitoring unit may be designed such that, with regard to the inner drawers 9, 10 and the outer drawer 11, no collision can occur during the driven movement of one of the drawers 9-11. Assuming that only driven movements of all the drawers 4-14 are desired, and, for example, a state as shown in FIG. 1 occurs and the outer drawer 11, which is illustrated as being entirely open, is intended to be closed in a driven manner, various options can be provided for collision avoidance. For example, the inner drawer 10, which is illustrated half-open, must first of all be closed completely before the outer drawer 11 moves from the entirely open position to the entirely closed position. This can be achieved in that, for example, when someone issues a closing command for the outer drawer 11, the system or the monitoring unit monitors that, first of all, the inner drawer 10 is moved to the closed position, after which the outer drawer 11 is closed completely in an uninterrupted movement.

Alternatively, it would also be feasible for the outer drawer 11 first of all to be moved only so far in the direction of the furniture housing 2, and then to be stopped, in such a way that no collision occurs with the half-open inner drawer 10. The complete closing movement of the inner drawer 10 then takes place and, once it has reached its closed position, the outer drawer 11 is moved to the completely closed position. The invention always prevents any other drawer from being moved in a driven manner while one drawer is being moved in a driven manner. This also makes it possible in particular to preclude trapping hazards for body parts such as fingers, hands or arms, which can occur when two adjacent drawers, which are not an inner drawer and associated outer drawer, move past one another in a driven manner at the same time, for example one of the adjacent drawers 6, 7, 8, 13, 14 and 5 with respect to the drawer 11, and form a gap, for example by their moving front parts, which represents a trapping hazard.

In principle, the monitoring unit can also be designed such that this principle is implemented only for a group of drawers that is defined from all the drawers 4 to 14 which are accommodated in the furniture housing 2, in which case only one drawer from the group can in each case be moved in a driven manner, and none of the other furniture drawers in the group are moveable in a driven manner during this time.

If, for example, a group of drawers is formed in the piece of furniture 1, which group comprises the drawers 8-14, only one drawer from this group can be moved in a driven manner at any time. For example, as long as the drawer 13 is being moved in a driven manner, none of the drawers 8 to 12 and 14 are moveable in a driven manner. This makes it possible to ensure that no injury can occur to the hands or fingers of a person resulting from front parts of the group of drawers under consideration moving past one another, for example, between the front part 13*a* of the drawer 13 and one of the front parts 8*a*-12*a* and 14*a*.

At least one of the remaining drawers 4-7 which do not belong to the group that has been formed can in contrast also be moved in a driven manner during the driven movement of the drawer 13, since this is not critical with respect to any possible trapping hazard between the drawer 13 and one of the drawers 4-7. According to the invention, the drawers 4-7 can also advantageously be monitored by the monitoring unit in that only one of these drawers is moveable in a driven manner and no other drawer from this group can be moved in a driven manner during this time, thus precluding any hazard resulting from two of the drawers from the drawers 4-7 being moved in a driven manner simultaneously.

The exemplary embodiment in FIG. 1 shows a piece of furniture with a plurality of drawers. However, the invention also relates to other pieces of furniture with furniture parts which can be moved in a driven manner, such as doors, hatches, tablar panels, wire baskets, pharmacy cabinets, rotating racks, carousels or the like.

LIST OF REFERENCE SYMBOLS

1 Piece of furniture
2 Furniture housing
2*a* Side wall
2*b* Side wall
2*c* Upper part
2*d* Bottom part
2*e* Inner wall
2*f* Inner wall
3 Furniture drawer units
4 Drawer
5 Drawer
6 Drawer
7 Drawer
8 Drawer
8*a* Front part
9 Inner drawer
9*a* Front part
10 Inner drawer
10*a* Front part
11 Outer drawer
11*a* Front part
12 Drawer
12*a* Front part
13 Drawer
13*a* Front part
14 Drawer
14*a* Front part
15 Handle element
16 Handle element
17 Handle element

We claim:

1. A device for controlling the movement of a plurality of moveable furniture parts which can be moved in a driven manner relative to a stationary furniture part, comprising a drive unit for moving the moveable furniture parts, and a monitoring unit for monitoring the movement of the moveable furniture parts, wherein the monitoring unit controls movement of the moveable furniture parts such that, when a first moveable furniture part is moving in a driven manner in a predetermined movement section, movement of the other moveable furniture parts of the plurality of moveable furniture parts is precluded.

2. The device as claimed in claim 1, wherein the monitoring unit allows driven movement of a second furniture part of the plurality of moveable furniture parts which can be moved in a driven manner when the first moveable furniture part is moving in a driven manner outside of the predetermined movement section.

3. The device as claimed in claim 1, wherein the predetermined movement section is a section in which a risk of trapping an external object exists when two furniture parts are moving in a driven manner in opposite directions.

4. The device as claimed in claim 1, wherein the predetermined movement section comprises an area from an open position to a predetermined distance before a closed position.

5. The device as claimed in claim 4, wherein the monitoring unit allows driven movement of one of the other moveable furniture parts of the plurality of moveable furniture parts during a closing movement of the first moveable furniture part, after the first moveable furniture part passes a point approximately 10 to 70 mm before the closed position.

6. The device as claimed in claim 1, wherein the monitoring unit ignores an input command from an outside source to initiate movement of one of the other moveable furniture parts of the plurality of moveable furniture parts while the first moveable furniture part is moving in a driven manner in the predetermined movement section.

7. The device as claimed in claim 1, wherein the monitoring unit adds a time offset to an input command for initiation of the movement of a second furniture part of the plurality of furniture parts when the first moveable furniture part is moving and is within a comparatively short predetermined time interval before the first moveable furniture part leaves the predetermined movement section.

8. The device as claimed in claim 7, wherein the time offset is variable.

9. The device as claimed in claim 7, wherein during the predetermined time interval, the monitoring unit accepts the input command, for initiation of the movement of the second furniture part occurring first in time and adds a time offset, for initiation of the movement of the second furniture part, and ignores any subsequent input commands for initiation of the movement of other furniture parts of the plurality of furniture parts.

10. The device as claimed in claim 1, wherein the monitoring unit decelerates a velocity of one first moveable furniture part over a predefined distance before reaching a stationary position, and a driven movement of a second furniture part is permitted while the first moveable furniture part is moving at a reduced velocity.

11. The device as claimed in claim 1, wherein the monitoring unit monitors the movement of a defined group of moveable furniture parts that are a subset of the plurality of furniture parts which can be moved in a driven manner and are accommodated in an area, such that when one moveable furniture part in the defined group of moveable furniture parts is moving in a driven manner in the predetermined movement section, none of the other furniture parts in the defined group can be moved in a driven manner.

12. A piece of furniture comprising the device as claimed in claim 1.

13. A method for configuring a device for controlling the movement of a plurality of moveable furniture parts, the method comprising configuring a monitoring unit for controlling the movement of the plurality of moveable furniture parts relative to a stationary furniture part; and configuring the monitoring unit for controlling the movement of each moveable furniture part relative to other moveable furniture parts of the plurality of moveable furniture parts.

14. The method of claim 13, wherein the monitoring unit is configured to monitor and control the movement of a defined group of moveable furniture parts that are a subset of the plurality of moveable furniture parts.

15. The method of claim 13, wherein configuring the monitoring unit is performed before installation.

16. The method of claim 13, wherein configuring the monitoring unit is performed during installation.

17. The device of claim 1, wherein parameters for controlling the movement of the moveable furniture parts are configured in the monitoring unit before installation.

18. The device of claim 1, wherein parameters for controlling the movement of the moveable furniture parts are configured in the monitoring unit during installation.

* * * * *